US006633735B2

(12) United States Patent
Kellie et al.

(10) Patent No.: US 6,633,735 B2
(45) Date of Patent: Oct. 14, 2003

(54) REDUCTION OF SEAM MARK FROM AN ENDLESS SEAMED ORGANOPHOTORECEPTOR BELT

(75) Inventors: Truman F. Kellie, Lakeland, MN (US); William D. Edwards, New Richmond, WI (US)

(73) Assignee: Samsung Electronics Co., Ltd., Suwon (KR)

( * ) Notice: Subject to any disclaimer, the term of this patent is extended or adjusted under 35 U.S.C. 154(b) by 3 days.

(21) Appl. No.: 09/995,035

(22) Filed: Nov. 26, 2001

(65) Prior Publication Data

US 2002/0064397 A1 May 30, 2002

Related U.S. Application Data

(60) Provisional application No. 60/253,855, filed on Nov. 29, 2000.

(51) Int. Cl.[7] ..... G03G 15/06
(52) U.S. Cl. ..... 399/55; 399/162
(58) Field of Search ..... 399/55, 162, 240, 399/270, 285; 430/103, 117, 120

(56) References Cited

U.S. PATENT DOCUMENTS

| | | | | |
|---|---|---|---|---|
| 4,586,807 A | * | 5/1986 | Yuasa | 399/310 |
| 5,184,184 A | * | 2/1993 | Hayashi et al. | 399/35 |
| 5,489,972 A | * | 2/1996 | Shuster et al. | 399/313 |
| 5,549,999 A | | 8/1996 | Swain et al. | 430/127 |
| 5,650,253 A | | 7/1997 | Baker et al. | 430/119 |
| 5,916,718 A | | 6/1999 | Kellie et al. | 430/45 |
| 5,966,573 A | * | 10/1999 | Yu et al. | 399/160 |
| 5,970,304 A | | 10/1999 | Stemmle | 399/364 |
| 5,997,974 A | | 12/1999 | Schlueter, Jr. et al. | 428/58 |
| 6,055,396 A | * | 4/2000 | Pang | 399/164 |
| 6,106,762 A | | 8/2000 | Agur et al. | 264/512 |
| 6,324,368 B1 | * | 11/2001 | Seto | 399/249 |

FOREIGN PATENT DOCUMENTS

| | | | | |
|---|---|---|---|---|
| JP | 58113951 A | * | 7/1983 | G03G/15/00 |
| JP | 10020715 A | * | 1/1998 | G03G/21/00 |

* cited by examiner

*Primary Examiner*—Robert Beatty
(74) *Attorney, Agent, or Firm*—Mark A. Litman & Assoc. P.A.

(57) ABSTRACT

An electrophotographic imaging process includes the steps of (a) providing an organophotoreceptor belt having a photoconductive element on an electrically conductive substrate and a seam;

(b) providing an imaging apparatus comprising a developer roll;

(c) mounting the organophotoreceptor belt on the imaging apparatus;

(d) applying a first voltage to the photoconductive element;

(e) applying a second voltage to the developer roll when the seam is at a distance less than 10% of the circumference of the organophotoreceptor belt from the developer roll, otherwise applying a third voltage;

(f) applying a fourth voltage to the electrically conductive substrate;

(g) moving the organophotoreceptor belt;

(h) imagewise exposing the surface of the organophotoreceptor belt to radiation to reduce voltage in selected areas and thereby form a pattern of high voltage and low voltage areas on the surface;

(i) contacting the surface with a liquid ink comprising colorant particles in an organic liquid to create an image; and (j) transferring the toned image to a receiving medium;

wherein the second voltage is equal or less than the fourth voltage when the first and third voltage are positive or the second voltage is equal or greater than the fourth voltage when the first and third voltage are negative.

16 Claims, 2 Drawing Sheets

REDUCTION OF SEAM MARK FROM AN ENDLESS SEAMED ORGANOPHOTORECEPTOR BELT

This application claims the benefit of provisional application No. 60/253,855 filed on Nov. 29, 2000.

BACKGROUND OF THE INVENTION

1. Field of Invention

This invention relates to an electrophotographic process suitable for use in electrophotography and, more specifically, to an electrophotographic process of reducing seam marks from an endless seamed organophotoreceptor belt on prints produced by the process.

2. Background of the Art

In electrophotography, an organophotoreceptor in the form of a plate, belt, or drum having an electrically insulating photoconductive element on an electrically conductive substrate is imaged by first uniformly electrostatically charging the surface of the photoconductive element, and then exposing the charged surface to a pattern of light. The light exposure selectively dissipates the charge in the illuminated areas, thereby forming a pattern of charged and uncharged areas. A liquid or solid toner is then deposited in either the charged or uncharged areas to create a toned image on the surface of the photoconductive element. The resulting visible toner image can be fixed to the photoreceptor surface or transferred to a surface of a suitable receiving medium such as sheets of material, including, for example, paper, metal, metal coated substrates, composites and the like. The imaging process can be repeated many times on the reusable photoconductive element.

The photoconductive element usually comprises a charge generating layer, a charge transport layer, and optionally other layers such as a barrier layer, a release layer, an adhesive layer, and a sub-layer. The purpose of the charge generating material is to assist in the generation of charge carriers (i.e., holes or electrons) upon exposure to light. The purpose of the charge transport material is to assist in accepting these charge carriers and transport them through the charge transport layer in order to discharge a surface charge on the photoconductive element.

It is a common practice to have the organophotoreceptor in the form of belt. Although it is ideal to provide a seamless organophotoreceptor belt, where there is no seam in the belt which mechanically or electrostatically interferes with any operation that the belt performs or any operation that may be performed on the belt, the manufacture of seamless organophotoreceptor belts requires rather sophisticated manufacturing processes which are expensive and difficult to control. As a result, seamed organophotoreceptor belts are widely used in electrophotographic applications. Current techniques to manufacture seamed organophotoreceptor belts have largely relied on belts where the two ends of the organophotoreceptor belt material have been lapped or overlapped to form the seam or have butted against one another to form a seam. The seam is then fastened by heat or other means of adhesion such as by the use of an adhesive or welding techniques, such as ultrasonic welding or laser welding. Preferably, seamed organophotoreceptor belts are ultrasonically welded.

In the process of printing, ink is physically attracted to the seam or adsorbed into the seam of the organophotoreceptor belt and subsequently leaves an unattractive seam mark in the prints. The seam mark results from the ink in the seam being offset by the transfer roll during transfer of printed ink to paper. There are two phenomena that make contributions to the seam mark. They are 1) low solid (less than 5% by weight solids in the ink, less than 4.5% by weight, less than 4% by weight, and less than 3.5% by weight solids in the ink, e.g., ~3%) ink which "hides" in the roughness of the seam and is squeezed out by the transfer roll to make a very light seam mark on prints and 2) high solid ink (e.g., at least 80%, at least 85%, or equal to or greater than 90% by weight of solids) which is plated directly to the seam as it passes through each developer nip during printing and this contribution causes a very dark seam mark stain on prints.

There has been some work on eliminating the seam mark by coating the seams with materials with low conductivity. However, these attempts have not proven to be commercially acceptable, displaying reduced effectiveness either immediately or after a few hundred prints.

There has also been some work on eliminating the seam mark by continuously cleaning the transfer roll to prevent the offsetting of the seam mark on prints. Such cleaning methods also have been generally ineffective technologically or are not cost effective.

The smoothing of the seam by a belt welder can eliminate the contribution from the low solid ink. However, the plated ink on the seam cannot be eliminated by just smoothing of the seam. In order to eliminate plated ink from reaching the seam, the process condition for plating has to be changed momentarily for each developer station individually as the seam passes through the corresponding developer roll. This momentary change in the process condition can force the ink particles away from the seam. Consequently, the contribution from the high solids ink (plated ink) will be eliminated and no seam mark will show on prints. This adds an additional and potentially complex control step into the imaging process.

SUMMARY OF THE INVENTION

This invention eliminates seam mark from a seamed organophotoreceptor belt on prints by changing the electrical voltage of a developer roll momentarily when the seam passes through a developer roll. If there is more than one developer roll in the imaging apparatus, the momentary voltage change in each of the developer rolls takes place in turn when the seam passes through each of them sequentially.

In a first aspect, the invention features an electrophotographic imaging process that includes:

(a) providing an organophotoreceptor belt having 1) a photoconductive element on an electrically conductive substrate and 2) a seam (b) providing an imaging apparatus comprising a developer roll;

(c) mounting the organophotoreceptor belt on the imaging apparatus (d) applying a first voltage to the photoconductive element;

(e) after applying the first voltage, applying a second voltage to the developer roll when the seam is at a distance less than 10% of the circumference of the organophotoreceptor belt from the developer roll, and subsequentlly applying a third voltage to the developer roll;

(f) applying a fourth voltage to the electrically conductive substrate; (g) moving the organophotoreceptor belt;

(h) imagewise exposing the surface of the organophotoreceptor belt to radiation to reduce voltage in selected areas and thereby form a pattern of high voltage and low voltage areas on the surface;

(i) contacting the surface with a liquid ink comprising colorant particles in an organic liquid to create an image; and (j) transferring the toned image to a receiving medium; wherein A) the second voltage is equal to or less than the fourth voltage when the first voltage and third voltage are positive or B) the second voltage is equal or greater than the fourth voltage when the first voltage and third voltage are negative.

In a second aspect, the invention features an electrophotographic imaging process that includes:

(a) providing an organophotoreceptor belt having a photoconductive element on an electrically conductive substrate and a seam;

(b) providing an imaging apparatus comprising a developer roll and a squeegee roller;

(c) mounting the organophotoreceptor belt on the imaging apparatus;

(d) applying a first voltage to the photoconductive element;

(e) applying a second voltage to the developer roll when the seam is at a distance less than 10% of the circumference of the organophotoreceptor belt from the developer roll, subsequently applying a third voltage;

(f) applying a fourth voltage to the electrically conductive substrate;

(g) applying a fifth voltage to the squeegee roller;

(h) moving the organophotoreceptor belt;

(i) imagewise exposing the surface of the organophotoreceptor belt to radiation to reduce voltage in selected areas and thereby form a pattern of high voltage and low voltage areas on the surface;

(j) contacting the surface with a liquid ink comprising colorant particles in an organic liquid to create an image; and (k) transferring the toned image to a receiving medium; wherein A) the second voltage is equal or less than the fourth voltage when the first and third voltage are positive or B) the second voltage is equal or greater than the fourth voltage when the first and third voltage are negative. In the description of the process, steps are separated by alphanumeric headings for convenience, not necessarily for identifying a sequence. As is apparent to one skilled in the art, the sequence of steps may be reversed, such as the order in which the individual dispersions are prepared, and the like. Unless a sequence of steps is identified as being in sequence (as with identifying charging steps as first, second, third, and fourth charging steps), no sequence is required, except for those necessarily in sequence, as where a dispersion is coated, and the solids must have been dispersed before coating.

Other features and advantages of the invention will be apparent from the following description of the preferred embodiments thereof and from the claims.

BRIEF DESCRIPTION OF THE FIGURES

The foregoing advantages, construction and operation of the present invention will become more readily apparent from the following description and accompanying drawings in which.

DETAILED DESCRIPTION OF THE FIGURES

Liquid electrophotography is a technology which produces or reproduces an image on paper or other desired receiving material. Liquid electrophotography uses liquid inks which may be black or which may be of different colors for the purpose of plating solid colored material onto a surface in a well-controlled and image-wise manner to create the desired prints. In some cases, liquid inks used in electrophotography are substantially transparent or translucent to radiation emitted at the wavelength of the latent image generation device so that multiple image planes can be laid over one another to produce a multi-colored image constructed of a plurality of image planes with each image plane being constructed with a liquid ink of a particular color. Typically, a colored image is constructed of four image planes. The first three planes are constructed with a liquid ink in each of the three subtractive primary printing colors, yellow, cyan and magenta. The fourth image plane uses black ink, which need not be transparent to radiation emitted at the wavelength of the latent image generation device.

Figure 1:
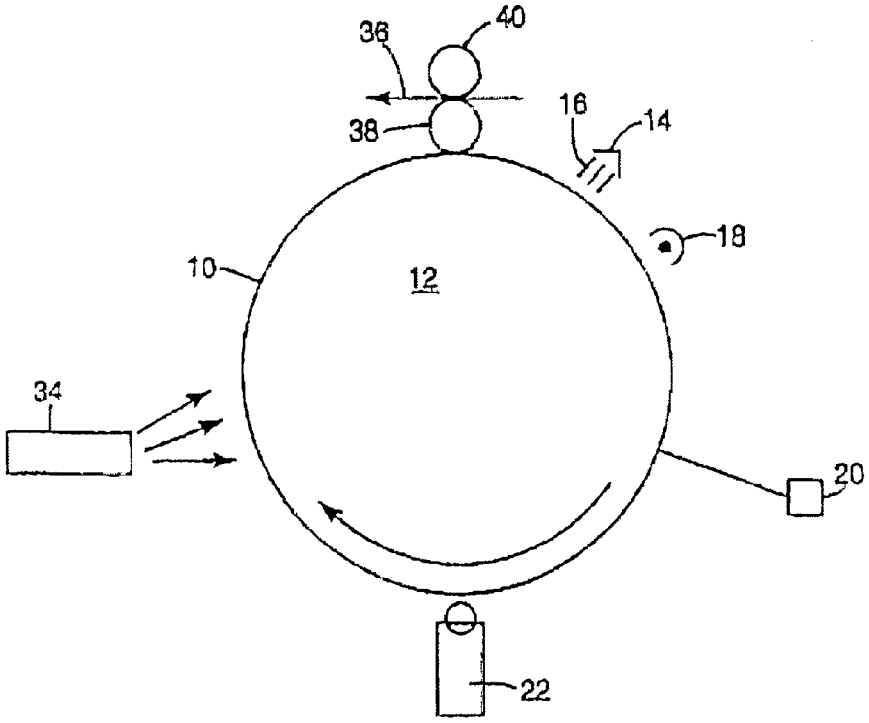
FIGS. 1 and 2 are diagrammatic illustrations of a basic liquid electrophotographic process in which the present invention has utility and an apparatus for performing that process.

The typical process involved in liquid electrophotography can be illustrated with respect to a single color by reference to FIG. 1. Light sensitive, organophotoreceptor 10 is arranged on or near the surface of a mechanical carrier such as drum 12. Organophotoreceptor 10 can be in the form of a belt or loop mounting on the outer surface of the drum. The mechanical carrier could, of course, be a belt or other movable support object. Drum 12 rotates in the clockwise direction of FIG. 1 moving a given location of organophotoreceptor 10 past various stationary components which perform an operation relative to organophotoreceptor 10 or an image formed on drum 12.

Of course, other mechanical arrangements could be used which provide relative movement between a given location on the surface of organophotoreceptor 10 and various components which operate on or in relation to organophotoreceptor 10. For example, organophotoreceptor 10 could be stationary while the various components move past organophotoreceptor 10 or some combination of movement between both organophotoreceptor 10 and the various components could be facilitated. It is only important that there be relative movement between organophotoreceptor 10 and the other components. As this description refers to organophotoreceptor 10 being in a certain position or passing a certain position, it is to be recognized and understood that what is being referred to is a particular spot or location on organophotoreceptor 10 which has a certain position or passes a certain position relative to the components operating on organophotoreceptor 10.

In FIG. 1, as drum 12 rotates, organophotoreceptor 10 moves past erase lamp 14. When organophotoreceptor 10 passes under erase lamp 14, radiation 16 from erase lamp 14 impinges on the surface of organophotoreceptor 10 causing any residual charge remaining on the surface of organophotoreceptor 10 to "bleed" away. Thus, the surface charge distribution of the surface of organophotoreceptor 10 as it exits erase lamp 14 is quite uniform and nearly zero depending upon the organophotoreceptor.

As drum 12 continues to rotate and organophotoreceptor 10 next passes under charging device 18, such as a roll corona, a uniform positive or negative charge is imposed upon the surface of organophotoreceptor 10. In a preferred embodiment, the charging device 18 is a positive DC corona and the surface of organophotoreceptor 10 is uniformly charged to around 600 volts depending on the capacitance of organophotoreceptor, while the electrically conductive substrate of the organophotoreceptor is grounded or controlled at a less positive or even negative voltage. In another preferred embodiment, the charging device 18 is a negative DC corona and the surface of organophotoreceptor 10 is uniformly charged to around −600 volts depending on the capacitance of organophotoreceptor, while the electrically conductive substrate of the organophotoreceptor is grounded or controlled at a less negative or even positive voltage. This prepares the surface of organophotoreceptor 10 for an image-wise exposure to radiation by laser scanning device 20 as drum 12 continues to rotate. Wherever radiation from laser scanning device 20 impinges on the surface of organophotoreceptor 10, the surface charge of organophotoreceptor 10 is reduced significantly while areas on the surface of organophotoreceptor 10 which do not receive radiation are not appreciably discharged. Areas of the surface of organophotoreceptor 10 which receive some radiation are discharged to a degree that corresponds to the amount of radiation received. This results in the surface of organophotoreceptor 10 having a surface charge distribution which is proportional to the desired image information imparted by laser scanning device 20 when the surface of organophotoreceptor 10 exits from under laser scanning device 20.

As drum 12 continues to rotate, the surface of organophotoreceptor 10 passes by liquid ink developer station 22. The operation of liquid ink developer station 22 can be more readily understood by reference to FIG. 2. Liquid ink 24 is applied to the surface of image-wise charged organophotoreceptor 10 in the presence of a positive or negative electric field which is established by placing developer roll 26 near the surface of organophotoreceptor 10 and imposing a bias voltage on developer roll 26. Liquid ink 24 consists of positively or negatively charged "solid", but not necessarily opaque, toner particles of the desired color for this portion of the image being printed. The "solid" material in the ink, under force from the established electric field, migrates to and plates upon the surface of organophotoreceptor 10 in areas 28 where the surface voltage is less than the bias voltage of developer roll 26. The "solid" material in the ink will migrate to and plate upon the developer roll in areas 30 where surface voltage of organophotoreceptor 10 is greater than the bias voltage of developer roll 26. Excess liquid ink not sufficiently plated to either the surface of organophotoreceptor 10 or to developer roll 26 is removed.

The ink is further dried by drying mechanism 32 which may include a roll, vacuum box, heating source, or curing station. Drying mechanism 32 substantially transforms liquid ink 24 into a substantially dry ink film. The excess liquid ink 24 then returns to liquid ink developer station 22 for use in a subsequent operation. The "solid" portion 28 (ink film) of liquid ink 24 plated upon the surface of organophotoreceptor 10 matches the previous image-wise charge distribution previously place upon the surface of organophotoreceptor 10 by laser scanning device 20 and, hence, is an image-wise representation of the desired image to be printed.

Referring again to FIG. 1, ink film 28 from liquid ink 24 is further dried by drying mechanism 34. Drying mechanism 34 may be passive, may utilize active air blowers or may be other active devices such as rollers. In a preferred embodiment, drying mechanism 34 is a drying roll or image conditioning roller.

The ink film 28 portion of liquid ink 24, representing the desired image to be printed, is then transferred, either directly to the receiving medium 36 to be printed, or preferably and as illustrated in FIG. 1, indirectly by way of transfer rollers 38 and 40. Transfer is effected by differential tack of ink film 28 and transfer rollers 38 and 40. Typically, heat and pressure are utilized to fuse the image to receiving medium 36. The resultant "print" is a hard copy manifestation of the image information written by laser scanning device 22 and is of a single color, the color represented by liquid ink 24.

Figure 2:
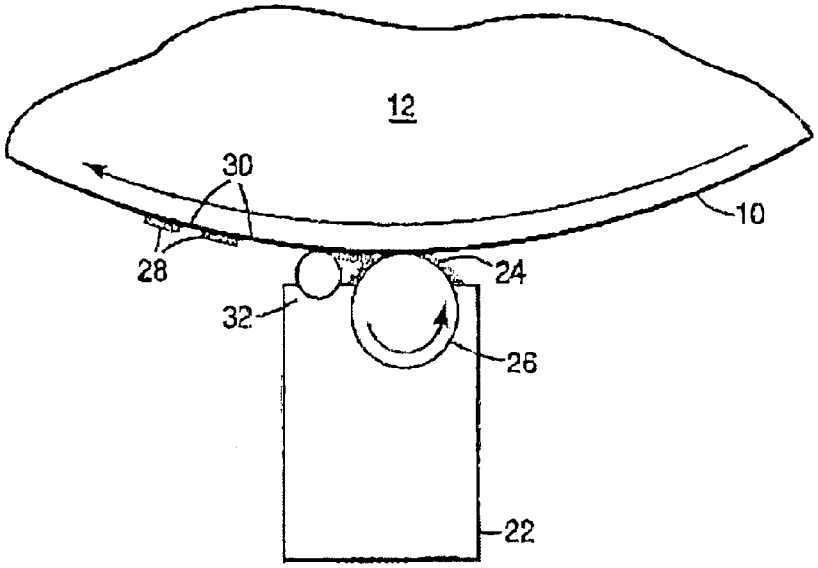

While organophotoreceptor 10, drum 12, erase lamp 14, charging device 18, laser scanning device 20, liquid ink developer station 22, liquid ink 24, developer roll 26, squeegee 32, drying mechanism 34 and transfer rollers 38 and 40 have been only diagrammatically illustrated in FIGS. 1 and 2 and only generally described with relation thereto, it is to be recognized and understood that these components are generally well known in the art of electrophotography and the exact material and construction of these elements is a matter of design choice which is also well understood in the art.

When there is a seam across the surface of organophotoreceptor 10, the seam usually has the same voltage as the electrically conductive substrate because the conductive layer of the electrically conductive substrate is exposed to the surface as a result of the seamed belt manufacturing process. Consequently, the ink will migrate to and plate upon the seam. The ink on the seam is dried and then transferred on the receiving medium 36 as undesirable seam marks.

One way to eliminate the plating of ink to the belt seam is to lower the developer bias voltage to a value which is not greater than the voltage of the seam if a positively charged ink is being used or to raise the developer bias voltage to a value which is not lower than the seam voltage if a negatively charged ink is used. In one preferred embodiment, the electrically conductive substrate of the organophotoreceptor belt, and thus the seam, is grounded at zero volts for printing. Although the grounded voltage connected to the electrically conductive substrate is preferred to be at zero volts, it can be adjusted at a different voltage according to this invention. Then the developer bias voltage is quickly lowered to zero volt before the seam passes through the developer nip and the developer bias voltage is quickly returned to the original bias voltage just after the seam passes through the developer nip. The timing of the beginning of the fall and the rise of the developer bias voltage depends on the speed and the circumference of the organophotoreceptor belt.

The fall or the rise of the developer bias voltage should occur when the seam is at a distance less than 10% of the circumference of the organophotoreceptor belt from the developer roll, preferably less than 5%, more preferably less than 2.5%, most preferably less than 1%. If the developer bias voltage falls too early and/or rises too late, the percentage of useful area on the organophotoreceptor belt for imaging process will be so low that it becomes not practical.

The fall time to lower the developer voltage from 500 volts to zero volt must be less than 500 milliseconds. The rise time to elevate the developer bias voltage from zero volts to 500 volts after the seam passes through the nip must also be less than 500 milliseconds. The rise or fall time should be less than 500 milliseconds, preferably less than 200 milliseconds, most preferably less than 100 milliseconds because the primary images might be negatively impacted by this seam mark elimination technique if the rise or fall time is longer than 500 milliseconds. It is also possible to apply the above seam mark elimination technique for a multi-color imaging process such as that described in FIG. 3. The momentary change in each developer voltage for each color just takes turn sequentially when the seam passes each developer nip.

It is possible, of course, to make prints containing many colors rather than one single color. The basic liquid electrophotography process and apparatus described in FIGS. 1 and 2 can be used-by repeating the process described above for one color, a number of times wherein each repetition may image-wise expose a separate primary color plane, e.g., cyan, magenta, yellow or black, and each liquid ink 24 may be of a separate primary printing color corresponding to the image-wise exposed color plane. Superposition of four such color planes may be achieved with good registration onto the surface of organophotoreceptor 10 without transferring any of the color planes until all have been formed. Subsequent simultaneous transfer of all of these four color planes to a suitable receiving medium 36 may yield a quality color print.

While the above described liquid electrophotography process is suitable for construction of a multi-colored image, the process is somewhat slow because organophotoreceptor 10 must repeat the entire sequence for each color of the typical four color colored image. When the above process is performed for a particular color, e.g., cyan, laser scanning device 20 causes areas 20 organophotoreceptor 10 receiving radiation to at least partially discharged to create a surface charge distribution pattern of the surface of organophotoreceptor 10 which represents the portion of the image to be reproduced representing that particular color, e.g., cyan. After development by liquid developer station 22, the surface charge distribution of organophotoreceptor 10 is still quite variable (assuming at least some pattern to the image to be reproduced) and too low to be subsequently imaged. Organophotoreceptor 10 then must be erased to make the surface charge distribution uniform and must be again charged to provide a sufficient surface charge to allow a subsequent development process to plate liquid ink upon areas 28 of organophotoreceptor 10.

Figure 3:
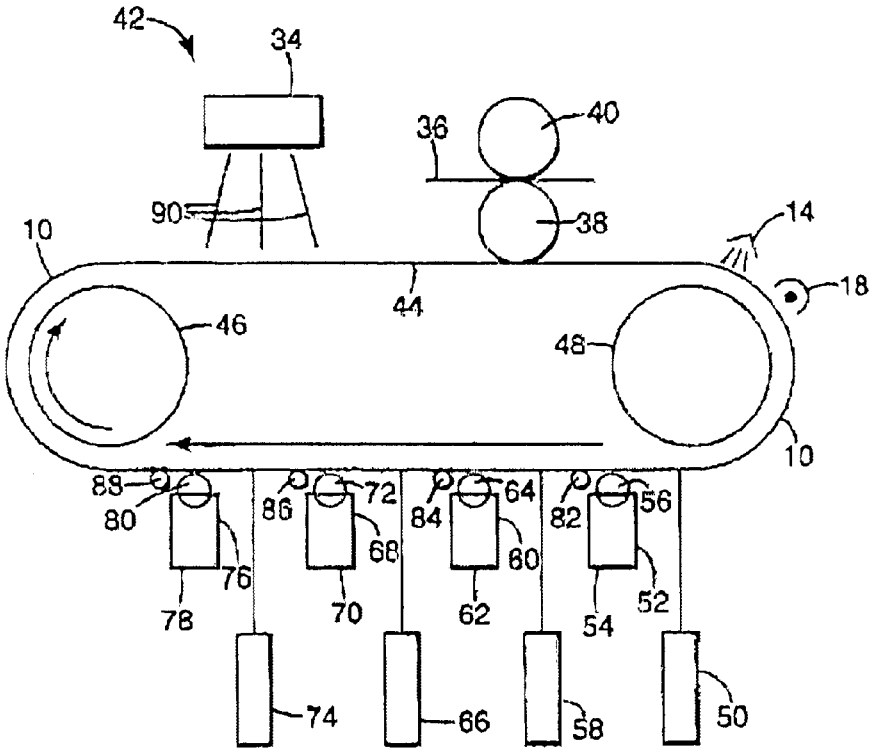
FIG. 3 is a diagrammatic illustration of an apparatus and a method for producing a multi-colored image in accordance with the present invention.

While not required by all embodiments of the present invention, FIG. 3 diagrammatically illustrates an apparatus 42 and a method for producing a multicolored image. Organophotoreceptor 10 is mechanically supported by belt 44 which rotates in a clockwise direction around rollers 46 and 48. Organophotoreceptor 10 is first conventionally erased with erase lamp 14. Any residual charge left on organophotoreceptor 10 after the preceding cycle is preferably removed by erase lamp 14 and then conventionally charged using charging device 18, such procedures being well known in the art. When so charged, the surface of organophotoreceptor 10 is uniformly charged to around positive (or negative) 600 volts, preferably. Laser scanning device 50, similar to laser scanning device 20 illustrated in FIG. 1, exposes the surface of organophotoreceptor 10 to radiation in an image-wise pattern corresponding to a first color plane of the image to be reproduced.

With the surface of organophotoreceptor so image-wise charged, charged pigment particles in liquid ink 54 corresponding to the first color plane will migrate to and plate upon the surface of organophotoreceptor 10 in areas where the surface voltage of organophotoreceptor 10 is less than the bias of developer roll 56 associated with liquid ink developer station 52. The charge neutrality of liquid ink 54 is maintained by negatively (or positively) charged counter ions which balance the positively (or negatively) charged pigment particles. Counter ions are deposited on the surface of organophotoreceptor 10 in areas where the surface voltage is greater than the bias voltage of developer roll 56 associated with liquid ink developer station 52.

At this stage, organophotoreceptor 10 contains on its surface an image-wise distribution of plated "solids" of liquid ink 52 in accordance with a first color plane. The surface charge distribution of organophotoreceptor 10 has also been recharged with plated ink particles as well as with transparent counter ions from liquid ink 52 both being governed by the image-wise discharge of organophotoreceptor 10 due to laser scanning device 50. Thus, at this stage the surface charge of organophotoreceptor 10 is also quite uniform. Although not all of the original surface charge of organophotoreceptor may have been obtained, a substantial portion of the previous surface charge of organophotoreceptor has been recaptured. With such solution recharging, organophotoreceptor 10 is now ready to be processed for the next color plane of the image to be reproduced.

As belt 44 continues to rotate, organophotoreceptor 10 next is image-wise exposed to radiation from laser scanning device 58 corresponding to a second color plane. Note that this process occurs during a single revolution of organophotoreceptor 10 by belt 44 and without the necessity of organophotoreceptor 10 being subjected to erase subsequent to exposure to laser scanning device 50 and liquid ink development station 52 corresponding to a first color plane. The remaining charge on the surface of organophotoreceptor 10 is subjected to radiation corresponding to a second color plane. This produces an image-wise distribution of surface charge on organophotoreceptor 10 corresponding to the second color plane of the image.

The second color plane of the image is then developed by developer station 60 containing liquid ink 60. Although liquid ink 62 contains "solid" color pigments consistent with the second color plane, liquid ink 62 also contains substantially transparent counter ions which, although they may have differing chemical compositions than substantially transparent counter ions of liquid ink 54, still are substantially transparent and oppositely charged to the "solid" color pigments. Developer roll 64 provides a bias voltage to allow "solid" color pigments of liquid ink 62 create a pattern of "solid" color pigments on the surface of organophotoreceptor 10 corresponding to the second color plane. The transparent counter ions also substantially recharge organophotoreceptor 10 and make the surface charge distribution of organophotoreceptor 10 substantially uniform so that another color plane may be placed upon organophotoreceptor 10 without the necessity of erase nor corona charging.

A third color plane of the image to be reproduced is deposited on the surface of organophotoreceptor 10 is similar fashion using laser scanning device 64 and developer station 70 containing liquid ink 68 using developer roll 72. Again, the surface charge existing on organophotoreceptor 10 following development of the third color plane may be somewhat less than existed prior to exposure to laser scanning device 66 but will be substantially "recharged" and will be quite uniform allowing application of the fourth color plane without the necessity of erase or corona charging.

Similarly, a fourth color plane is deposited upon organophotoreceptor 10 using laser scanning device 74 and developer station 78 containing liquid ink 76 using developer roll 80.

Preferably, excess liquid from liquid inks 54, 62, 70 and 78 is "squeezed" off using a roller similar to roller 32 described with respect to FIG. 1. Such a roller may be used in conjunction with any of developer stations 52, 60, 68 or 76 or all of them.

The plated solids from liquid inks 52, 60, 68 and 76 are dried in a drying mechanism 34 similar to that described with respect to FIG. 1. Drying mechanism 34 may be passive, may utilize active air blowers or may be other active devices such as drying rollers, vacuum devices, coronas, etc.

The completed four color image is then transferred, either directly to the receiving medium 36 to be printed, or preferably and as illustrated in FIG. 3, indirectly by way of transfer rollers 38 and 40. Typically, heat and/or pressure are utilized to fix the image to receiving medium 36. The resultant "print" is a hard copy manifestation of the four color image.

With proper selection of charging voltages, organophotoreceptor capacity and liquid ink, this process may be repeated an indeterminate number of times to produce a multi-colored image having an indeterminate number of color planes. Although the process and apparatus has been described above for conventional four color images, the process and apparatus are suitable for multi-color images having two or more color planes.

One type of ink found particularly suitable for use as liquid inks 52, 60, 68 and 76 consists of ink materials that are substantially transparent and of low absorptivity to radiation from laser scanning devices 50, 58, 66 and 74. This allows radiation from laser scanning devices 50, 58, 66 and 74 to pass through the previously deposited ink or inks and impinge on the surface of organophotoreceptor 10 and reduce the deposited charge. This type of ink permits subsequent imaging to be effected through previously developed ink images as when forming a second, third, or fourth color plane without consideration for the order of color deposition. It is preferable that the inks transmit at least 80% and more preferably 90% of radiation from laser scanning devices 50, 58, 66 and 74 and that the radiation is not significantly scattered by the deposited ink material of liquid inks 52, 60, 68 and 76.

One type of ink found particularly suitable for use as liquid inks 52, 60, 68 and 76 are organosols which exhibit excellent imaging characteristics in liquid immersion development. For example, the organosol liquid inks exhibit low bulk conductivity, low free phase conductivity, low charge/mass and adequate mobility, all desirable characteristics for producing high resolution, background free images with high optical density. In particular, the low bulk conductivity, low free phase conductivity and low charge/mass of the inks allow them to achieve high developed optical density over a wide range of solids concentrations, thus improving their extended printing performance relative to conventional inks.

These color liquid inks on development form colored films which transmit incident radiation such as, for example, near infrared radiation, consequently allowing the photoconductor layer to discharge, while non-coalescent particles scatter a portion of the incident light. Non-coalesced ink particles therefore result in the decreasing of the sensitivity of the photoconductor to subsequent exposures and consequently there is interference with the overprinted image.

These inks have low Tg values which enables the inks to form films at room temperature. Normal room temperature (19°–20° C.) is sufficient to enable film forming and of course the ambient internal temperatures of the apparatus during operation which tends to be at a higher temperature (e.g., 25°–40° C.) even without specific heating elements is sufficient to cause the ink or allow the ink to form a film.

Residual image tack after transfer may be adversely affected by the presence of high tack monomers, such as ethyl acrylate, in the organosol. Therefore, the organosols are generally formulated such that the organosol core preferably has a glass transition temperature (Tg) less than room temperature (25° C.) but greater than −10° C. This permits the inks to rapidly self-fix under normal room temperature or higher development conditions and also produce tack-free fixed images which resist blocking.

The carrier liquid may be selected from a wide variety of materials which are well known in the art. The carrier liquid is typically oleophilic, chemically stable under a variety of conditions, and electrically insulating. Electrically insulating means that the carrier liquid has a low dielectric constant and a high electrical resistivity. Preferably, the carrier liquid has a dielectric constant of less than 5, and still more preferably less than 3. Examples of suitable carrier liquids are aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like), silicone oils and blends of these solvents. Preferred carrier liquids include paraffinic solvent blends sold under the names Isopar® G liquid, Isopar® H liquid, Isopar® K liquid and Isopar® L liquid (manufactured by Exxon Chemical Corporation, Houston, Tex.). The preferred carrier liquid is Norpar® 12 liquid, also available from Exxon Corporation.

The toner particles are comprised of colorant embedded in a thermoplastic resin. The colorant may be a dye or more preferably a pigment. The resin may be comprised of one or more polymers or copolymers which are characterized as being generally insoluble or only slightly soluble in the carrier liquid; these polymers or copolymers comprise a resin core. In addition, superior stability of the dispersed toner particles with respect to aggregation is obtained when at least one of the polymers or copolymers (denoted as the stabilizer) is an amphipathic substance containing at least one chain-like component of molecular weight at least 500 which is solvated by the carrier liquid. Under such conditions, the stabilizer extends from the resin core into the carrier liquid, acting as a steric stabilizer as discussed in Dispersion Polymerization (Ed. Barrett, Interscience., p. 9 (1975). Preferably, the stabilizer is chemically incorporated into the resin core, i.e., covalently bonded or grafted to the core, but may alternatively be physically or chemically adsorbed to the core such that it remains as an integral part of the resin core.

The composition of the resin is preferentially manipulated such that the organosol exhibits an effective glass transition temperature (Tg) of less than 25° C. (more preferably less than 6° C.), thus causing an ink composition of liquid inks 52, 60, 68 and 76 containing the resin as a major component to undergo rapid film formation (rapid self fixing) in printing or imaging processes carried out at temperatures greater than the core Tg (preferably at or above 25° C.). The use of low Tg resins to promote rapid self fixing of printed or toned images is known in the art, as exemplified by Film Formation (Z. W. Wicks, Federation of Societies for Coatings Technologies, p. 8 (1986). Rapid self-fixing is thought to avoid printing defects (such as smearing or trailing-edge tailing) and incomplete transfer in high speed printing. For printing on plain paper, it is preferred that the core Tg be greater than minus 10° C. and, more preferably, be in the range from −5° C. to +5° C. so that the final image is not tacky and has good block resistance.

Such rapid self fixing is required of liquid inks 52, 60 and 68 to enable such liquid inks 52, 60 and 68 to film form before being subjected to overlay by a subsequent liquid ink 60, 68 and 76 in the formation of a subsequent color plane of the image. It is preferred that liquid inks 52, 60, 68 and 76 self fix within 0.5 seconds to enable the apparatus to operate at sufficient speed and to ensure image quality. It is generally believed that such rapid self-fixing will occur in liquid inks 52, 60, 68 and 76 which have greater than 75 percent volume fraction of solids in the image.

It is also preferred that the glass transition temperature (Tg) of liquid inks 52, 60, 68 and 76 be greater than −10° C. and less than +25° C. so that the final image is not tacky and has good block resistance. More preferred is a Tg between −5° C. and +5° C.

It is also preferred that liquid inks 52, 60, 68 and 76 have a low charge to mass ratio which assists in giving the resultant image high density. It is preferred that liquid inks 52, 60, 68 and 76 have a charge to mass ratio of from 0.025 to 0.1 microcoulombs/($cm^2$-OD). Liquid inks 52, 60, 68 and 76 have a charge to mass ratio of from 0.05 to 0.075 microcoulombs/($cm^2$-OD) in the most preferred embodiment. (This is the charge per developed optical density which is directly proportional to charge per mass.)

It is also preferred that liquid inks 52, 60, 68 and 76 have a low free phase conductivity which aids in providing high resolution, gives good sharpness and low background. It is preferred that liquid inks 52, 60, 68 and 76 have a free phase conductivity of less than 30 percent at 1 percent solids. It is still more preferred that liquid inks 52, 60, 68 and 76 have a free phase conductivity of less than 20 percent at 1 percent solids. A free phase conductivity of less than 10 percent at 1 percent solids is most preferred for liquid inks 52, 60, 68 and 76.

Examples of resin materials suitable for use in liquid inks 52, 60, 68 and 76 include polymers and copolymers of (meth)acrylic esters; including methyl acrylate, ethyl acrylate, butyl acrylate, ethylhexyl acrylate, 2-ethylhexylmethacrylate, lauryl acrylate, octadecyl acrylate, methyl methacrylate, ethyl methacrylate, lauryl methacrylate, 2-hydroxy ethyl methacrylate, octadecyl methacrylate, 3,3,5-trimethylcyclohexyl methacrylate, dimethylaminoethyl methacryalte, diethylaminoethyl methacryalte, isobornyl acrylate, and other polyacrylates. Other polymers may be used in conjunction with the aforementioned materials, including melamine and melamine formaldehyde resins, phenol formaldehyde resins, epoxy resins, polyester resins, styrene and styrene/acrylic copolymers, acrylic and methacrylic esters, cellulose acetate and cellulose acetate-butyrate copolymers, and poly(vinyl butyral) copolymers.

The colorants which may be used in liquid inks 52, 60, 68 and 76 include virtually any dyes, stains or pigments which may be incorporated into the polymer resin, which are compatible with the carrier liquid, and which are useful and effective in making visible the latent electrostatic image. Examples of suitable colorants include: Phthalocyanine blue (C.I. Pigment Blue 15 and 16), Quinacridone magenta (C.I. Pigment Red 122, 192, 202 and 206), Rhodamine YS (C.I. Pigment Red 81), diarylide (benzidine) yellow (C.I. Pigment Yellow 12, 13, 14, 17, 55, 83 and 155) and arylamide (Hansa) yellow (C.I. Pigment Yellow 1, 3, 10, 73, 74, 97, 105 and 111); organic dyes, and black materials such as finely divided carbon and the like.

The optimal weight ratio of resin to colorant in the toner particles is on the order of 1/1 to 20/1, most preferably between 10/1 and 3/1. The total dispersed "solid" material in the carrier liquid typically represents 0.5 to 20 weight percent, most preferably between 0.5 and 3 weight percent of the total liquid developer composition.

Liquid inks 52, 60, 68 and 76 include a soluble charge control agent, sometimes referred to as a charge director, to provide uniform charge polarity of the toner particles. The charge director may be incorporated into the toner particles, may be chemically reacted to the toner particle, may be chemically or physically adsorbed onto the toner particle (resin or pigment), and may be chelated to a functional group incorporated into the toner particle, preferably via a functional group comprising the stabilizer. The charge director acts to impart an electrical charge of selected polarity (either positive or negative) to the toner particles. Any number of charge directors described in the art may be used herein; preferred positive charge directors are the metallic soaps. The preferred charge directors are polyvalent metal soaps of zirconium and aluminum, preferably zirconium octoate.

Charging device 18 is preferably a scorotron type corona charging device. Charging device 18 has high voltage wires (not shown) coupled to a suitable positive high voltage source of plus 4,000 to plus 8,000 volts. The grid wires of charging device 18 are disposed from about 1 to about 3 millimeters from the surface of organophotoreceptor 10 and are coupled to an adjustable positive voltage supply (not shown) to obtain an apparent surface voltage on organophotoreceptor 10 in the range plus 600 volts to plus 1000 volts or more depending upon the capacitance of organophotoreceptor. While this is the preferred voltage range, other voltages may be used. For example, thicker organophotoreceptors typically require higher voltages. The voltage required depends principally on the capacitance of organophotoreceptor 10 and the charge to mass ratio of the liquid ink utilized as the toner for apparatus 42. Of course, connection to a positive voltage is required for a positive charging organophotoreceptor 10. Alternatively, a negatively charging organophotoreceptor 10 using negative voltages would also be operable. The principles are the same for a negative charging organophotoreceptor 10.

Laser scanning device 50 imparts image information associated with a first color plane of the image, laser scanning device 58 imparts image information associated with a second color plane of the image, laser scanning device 66 imparts image information associated with a third color plane of the image and laser scanning device 74 imparts image information associated with a fourth color plane of the image. Although each of laser scanning devices 50, 58, 66 and 74 are associated with a separate color of the image and operate in the sequence as described above with reference to FIG. 3, for convenience they are described together below.

Laser scanning devices 50, 58, 66 and 74 include a suitable some of high intensity electromagnetic radiation. The radiation may be a single beam or an array of beams. The individual beams in such an array may be individually modulated. The radiation impinges, for example, on organophotoreceptor 10 as a line scan generally perpendicular to the direction of movement of organophotoreceptor 10 and at a fixed position relative to charging device 18.

The radiation scans and exposes organophotoreceptor 10 preferably while maintaining exact synchronism with the movement of organophotoreceptor 10. The image-wise exposure causes the surface charge of organophotoreceptor 10 to be reduced significantly wherever the radiation impinges. Areas of the surface of organophotoreceptor 10 where the radiation does not impinge are not appreciably discharged. Therefore, when organophotoreceptor 10 exits from under the radiation, its surface charge distribution is proportional to the desired image information.

The wavelength of the radiation to be transmitted by laser scanning devices 50, 58 and 66 is selected to have low absorption through the first three color planes of the image. The fourth image plane is typically black. Black is highly absorptive to radiation of all wavelengths which would be useful in the discharge of organophotoreceptor 10. Additionally, the wavelength of the radiation of laser scanning devices 50, 58, 66 and 74 selected should preferably correspond to the maximum sensitivity wavelength of organophotoreceptor 10. Preferred sources for laser scanning devices 50, 58, 66 and 74 are infrared diode lasers and light emitting diodes with emission wavelengths over 700 nanometers. Specially selected wavelengths in the visible may also be usable with some combinations of colorants. The preferred wavelength is 780 nanometers.

The radiation (a single beam or array of beams) from laser scanning devices 50, 58, 66 and 74 is modulated conventionally in response to image signals for any single color plane information from a suitable source such as a computer memory, communication channel, or the like. The mechanism through which the radiation from laser scanning devices is manipulated to reach organophotoreceptor 10 is also conventional.

The radiation strikes a suitable scanning element such as a rotating polygonal mirror (not shown) and then passes through a suitable scan lens (not shown) to focus the radiation at a specific raster line position with respect to organophotoreceptor 10. It will of course be appreciated that other scanning means such as an oscillating mirror, modulated fiber optic array, waveguide array, or suitable image delivery system may be used in place of or in addition to a polygonal mirror. For digital halftone imaging, it is preferred that radiation should be able to be focused to diameters of less than 42 microns at the one-half maximum intensity level assuming a resolution of 600 dots per inch. A lower resolution may be acceptable for some applications. It is preferred that the scan lens must be able to maintain this beam diameter across at least a 12 inches (30.5 centimeters) width.

The polygonal mirror typically is rotated conventionally at constant speed by controlling electronics which may include a hysteresis motor and oscillator system or a servo feedback system to monitor and control the scan rate. Organophotoreceptor 10 is moved orthogonal to the scan direction at constant velocity by a motor and position/velocity sensing devices past a raster line where radiation impinges upon organophotoreceptor 10. The ratio between the scan rate produced by the polygonal mirror and organophotoreceptor 10 movement speed is maintained constant and selected to obtain the required addressability of laser modulated information and overlap of raster lines for the correct aspect ratio of the final image. For high quality imaging, it is preferred that the polygonal mirror rotation and organophotoreceptor 10 speed are set so that at least 600 scans per inch, and still more preferably 1200 scans per inch, are imaged on organophotoreceptor 10. It is preferable not to have organophotoreceptor 10 travel substantially faster than about 3 inches/second (7.6 centimeters/second).

Developer station 54 develops the first color plane of the image, developer station 62 develops the second color plane of the image, developer station 70 develops the third color plane of the image and developer station 78 develops the fourth color plane of the image. Although each of developer stations 54, 62, 70 and 78 are associated with a separate color of the image and operate in the sequence as described above with reference to FIG. 3, for convenience they are described together below.

Conventional liquid ink immersion development techniques are used in developer stations 54, 62, 70 and 78. Two modes of development are known in the art, namely deposition of liquid ink 52, 60, 68 and 76 in exposed areas of organophotoreceptor 10 and, alternatively, deposition of liquid ink 52, 60, 68 and 76 in unexposed regions. The former mode of imaging can improve formation of halftone dots while maintaining uniform density and low background densities. Although the invention has been described using a discharge development system whereby the positively charged liquid ink 52, 60, 68 and 76 is deposited on the surface of organophotoreceptor 10 in areas discharged by the radiation, it is to be recognized and understood that an imaging system in which the opposite is true is also contemplated by this invention. Development is accomplished by using a uniform electric field produced by developer roll 56, 64, 72 and 80 spaced near the surface of organophotoreceptor 10.

Developer stations 54, 62, 70 and 78 consist of developer roll 56, 64, 72 and 80, squeegee roller 82, 84, 86 and 88, fluid delivery system, and a fluid return system. A thin, uniform layer of liquid ink 52, 60, 68 and 76 is established on a rotating, cylindrical developer roll 56, 64, 72 and 80. A bias voltage is applied to the developer roll intermediate to the unexposed surface potential of organophotoreceptor 10 and the exposed surface potential level of organophotoreceptor 10. The voltage is adjusted to obtain the required maximum density level and tone reproduction scale for halftone dots without any background being deposited. Developer roll 56, 64, 72 and 80 is brought into proximity with the surface of organophotoreceptor 10 immediately before the latent image formed on the surface of organophotoreceptor 10 passes beneath the developer roll 56, 64, 72 and 80. The bias voltage on developer roll 56, 64, 72 and 80 forces the charged pigment particles, which are mobile in the electric field, to develop the latent image. The charged "solid" particles in liquid ink 52, 60, 68 and 76 will migrate to and plate upon the surface of organophotoreceptor 10 in areas where the surface charge of organophotoreceptor 10 is less than the bias voltage of developer roll 56, 64, 72 and 80. The charge neutrality of liquid ink 52, 60, 68 and 76 is maintained by oppositely-charged substantially transparent counter ions which balance the charge of the positively charged ink particles. Counter ions are deposited on the surface organophotoreceptor 10 in areas where the surface voltage of organophotoreceptor 10 is greater than the developer roll bias voltage.

After plating is accomplished by developer roll 56, 64, 72 and 80, squeegee roller 82, 84, 86 and 88 then rolls over the developed image area on organophotoreceptor 10 removing the excess liquid ink 52, 60, 68 and 76 and successively leaving behind each developed color plane of the image. A bias voltage can be applied to the squeegee roller 82, 84, 86 and 88 to prevent plating on them, especially when the resistivity of the squeegee roller is lower than $1\times10^{10}$ ohm/square, preferably lower than $1\times10^{9}$ ohm/square. Alternatively, sufficient excess liquid ink remaining on the surface of organophotoreceptor 10 could be removed in order to effect film formation by vacuum techniques well known in the art. The ink deposited onto organophotoreceptor 10 should be rendered relatively firm (film-formed) by the developer roll 56, 64, 72 and 80, squeegee roller 82, 84, 86 and 88 or an alternative drying technique in order to prevent it from being washed off in a subsequent developing process(es) by developer stations 62, 70 and 78. Preferably, the ink deposited on organophotoreceptor should be dried enough to have greater than seventy-five percent by volume fraction of solids in the image.

The organophotoreceptor includes an electrically conductive substrate and a photoconductive element in the form of a single layer that includes both a charge transport compound and a charge generating compound in a polymeric binder. Preferably, however, the organophotoreceptor includes an electrically conductive substrate and a photoconductive element that is a bilayer construction featuring a charge generating layer and a separate charge transport layer. The charge generating layer may be located intermediate the electrically conductive substrate and the charge transport layer. Alternatively, the photoconductive element may be an inverted construction in which the charge transport layer is intermediate the electrically conductive substrate and the charge generating layer.

The electrically conductive substrate may be flexible, for example in the form of a flexible web or a belt, or inflexible, for example in the form of a drum. Typically, a flexible electrically conductive substrate comprises of an insulated substrate and a thin layer of an electrically conductive material. The insulated substrate may be paper or a film forming polymer such as a polyester such as polyethylene terephthalate (Dupont A and Dupont 442, commercially available from E.I. DuPont de Nemours & Company), polyimide, polysulfone, polyethylene naphthalate, polypropylene, nylon, polyester, polycarbonate, vinyl resins such as polyvinyl fluoride and polystyrene, and the like. Specific examples of supporting substrates included polyethersulfone (Stabar® S-100, commercially available from ICI), polyvinyl fluoride (Tedlar®, commercially available from E. I. DuPont de Nemours & Company), polybisphenol-A polycarbonate (Makrofol®, commercially available from Mobay Chemical Company) and amorphous polyethylene terephthalate (Melinar®, commercially available from ICI Americas, Inc.). The electrically conductive material may be graphite, carbon black, iodide, conductive polymers such as polypyroles and Calgon® Conductive polymer 261 (commercially available from Calgon Corporation, Inc., Pittsburgh, Pa.), metals such as aluminum, titanium, chromium, brass, gold, copper, palladium, nickel, or stainless steel, or metal oxide such as tin oxide or indium oxide. Preferably, the electrically conductive material is aluminum or indium tin oxide. Typically, the insulated substrate will have a thickness adequate to provide the required mechanical stability. For example, flexible web substrates generally have a thickness from about 0.01 to about 1 mm, while drum substrates generally have a thickness of from about 0.5 mm to about 2 mm.

The charge generating compound is a material which is capable of absorbing light to generate charge carriers, such as a dyestuff or pigment. Examples of suitable charge generating compounds include metal-free phthalocyanines, metal phthalocyanines such as titanium phthalocyanine, copper phthalocyanine, oxytitanium phthalocyanine, hydroxygallium phthalocyanine, squarylium dyes and pigments, hydroxy-substituted squarylium pigments, perylimides, polynuclear quinones available from Allied Chemical Corporation under the tradename Indofast® Double Scarlet, Indofast® Violet Lake B, Indofast® Brilliant Scarlet and Indofast® Orange, quinacridones available from DuPont under the tradename Monastral® Red, Monastral® Violet and Monastral® Red Y, naphthalene 1,4,5,8-tetracarboxylic acid derived pigments including the perinones, tetrabenzoporphyrins and tetranaphthaloporphyrins, indigo- and thioindigo dyes, benzothioxanthene-derivatives, perylene 3,4,9,10-tetracarboxylic acid derived pigments, polyazo-pigments including bisazo-, trisazo- and tetrakisazo-pigments, polymethine dyes, dyes containing quinazoline groups, tertiary amines, amorphous selenium, selenium alloys such as selenium-tellurium, selenium-tellurium-arsenic and selenium-arsenic, cadmium sulfoselenide, cadmiumselenide, cadmium sulfide, and mixtures thereof Preferably, the charge generating compound is oxytitanium phthalocyanine, hydroxygallium phthalocyanine or a combination thereof Preferably, the charge generation layer comprises a binder in an amount of from about 10 to about 90 weight percent and more preferably in an amount of from about 20 to about 75 weight percent, based on the weight of the charge generation layer.

There are many kinds of charge transport materials available for electrophotography. Suitable charge transport materials for use in the charge transport layer include, but are not limited to, pyrazoline derivatives, fluorine derivatives, oxadiazole derivatives, stilbene derivatives, hydrazone derivatives, carbazole hydrazone derivatives, triaryl amines, polyvinyl carbazole, polyvinyl pyrene, or polyacenaphthylene.

The charge transport layer typically comprises a charge transport material in an amount of from about 25 to about 60 weight percent, based on the weight of the charge transport layer, and more preferably in an amount of from about 35 to about 50 weight percent, based on the weight of the charge transport layer, with the remainder of the charge transport layer comprising the binder, and optionally any conventional additives. The charge transport layer will typically have a thickness of from about 10 to about 40 microns and may be formed in accordance with any conventional technique known in the art.

Conveniently, the charge transport layer may be formed by dispersing or dissolving the charge transport material and a polymeric binder in organic solvent, coating the dispersion and/or solution on the respective underlying layer and hardening (e.g., curing, polymerizing or drying) the coating. Likewise, the charge generation layer may be formed by dissolving or dispersing the charge generation compound and the polymeric binders in organic solvent, coating the solution or dispersion on the respective underlying layer and hardening (e.g., curing, polymerizing or drying) the coating.

The binder is capable of dispersing or dissolving the charge transport compound (in the case of the charge transport layer) and the charge generating compound (in the case of the charge generating layer). Examples of suitable binders for both the charge generating layer and charge transport layer include polystyrene-co-butadiene, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly (hydroxyether) resins, polyhydroxystyrene resins, novolak, poly(phenylglycidyl ether)-co-dicyclopentadiene, copolymers of monomers used in the above-mentioned polymers, and combinations thereof. Polycarbonate binders are particularly preferred for the charge transport layer, whereas polyvinyl butyral and polyester binders are particularly preferred for the charge generating layer. Examples of suitable polycarbonate binders for the charge transport layer include polycarbonate A which is derived from bisphenol-A, polycarbonate Z, which is derived from cyclohexylidene bisphenol, polycarbonate C, which is derived from methylbisphenol A, and polyestercarbonates.

The photoreceptor may include additional layers as well. Such layers are well-known and include, for example, barrier layer, release layer, adhesive layer, ground stripe, and sub-layer. The release layer forms the uppermost layer of the photoconductor element with the barrier layer sandwiched between the release layer and the photoconductive element. The adhesive layer locates and improves the adhesion between the barrier layer and the release layer. The sub-layer is a charge blocking layer and is located between the electrically conductive substrate and the photoconductive element. The sub-layer may also improve the adhesion between the electrically conductive substrate and the photoconductive element.

Suitable barrier layers include coatings such as crosslinkable siloxanol-colloidal silica coating and hydroxylated silsesquioxane-colloidal silica coating, and organic binders such as polyvinyl alcohol, methyl vinyl ether/maleic anhydride copolymer, casein, polyvinyl pyrrolidone, polyacrylic acid, gelatin, starch, polyurethanes, polyimides, polyesters, polyamides, polyvinyl acetate, polyvinyl chloride, polyvinylidene chloride, polycarbonates, polyninyl butyral, polyvinyl acetals such as acetoacetals and polyvinyl formal and polyvinyl butyral, polyacrylonitrile, polymethyl methacrylate, polyacrylates, polyvinyl carbazoles, copolymers of monomers used in the above-mentioned polymers, vinyl resins such as vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above organic binders optionally may contain small inorganic particles such as fumed silica, silica, titania, alumina, zirconia, or a combination thereof The typical particle size is in the range of 0.001 to 0.5 micrometers, preferably 0.005 micrometers. A preferred barrier layer is a 1:1 mixture of methyl cellulose and methyl vinyl ether/maleic anhydride copolymer with glyoxal as a crosslinker.

The release layer topcoat may comprise any release layer composition known in the art. Preferably, the release layer is a fluorinated polymer, siloxane polymer, fluorosilicone polymer, silane, polyethylene, polypropylene, or a combination thereof More preferably, the release layers comprises crosslinked silicone polymers.

Typical adhesive layers include film forming polymers such as polyester, polyvinylbutyral, polyvinylpyrolidone, polyurethane, polymethyl methacrylate, poly(hydroxy amino ether) and the like. Preferably, the adhesive layer comprises poly(hydroxy amino ether). If such layers are utilized, they preferably have a dry thickness between about 0.01 micrometer and about 5 micrometers.

Typical sub-layers include polyvinylbutyral, organosilanes, hydrolyzable silanes, epoxy resins, polyesters, polyamides, polyurethanes, silicones and the like. Preferably, the sub-layer has a dry thickness between about 20 Angstroms and about 2,000 Angstroms.

Typical electrically conductive ground stripe contains conductive particles, inorganic particle, a binder, and other additives. Preferably, the surface resistivity of the ground stripe is less than about $1\times10^4$ ohms per square.

Typical electrically conductive particles include carbon black, graphite, conducting polymers, vanadium oxide, copper, silver, gold, nickel tantalum, chromium, zirconium, vanadium, niobium, indium tin oxide, and the like. Preferably, preferably, the electrically conductive particles should have a particle size less than 10 micrometers. Generally, the concentration of the electrically conductive particles in the ground stripe is less than about 40 percent by weight based on the total weight of the dried ground stripe in order to maintain sufficient strength and flexibility for flexible ground stripe.

Typical inorganic particles include silicon dioxide, aluminum oxide, titanium dioxide, alpha-$Fe_2O_3$, $Fe_3O_4$, MgO, $SnO_2$, $ZrO_2$, quartz, topaz, $MgAl_2O_4$, SiC, diamond, and $BeAl_2O_4$ and the like. Preferably, the inorganic particle is aluminum oxide, titanium dioxide, $ZrO_2$, $SiO_2$, or a combination thereof. An average inorganic particle size between about 0.3 micrometer and about 5 micrometers is preferred. Generally, the electrically conductive ground stripe comprises from about 5 percent by weight to about 40 percent, preferably from 20% to about 40%, by weight of inorganic particles, based on the total weight of the dried electrically conductive ground stripe layer.

Typical thermoplastic resins can be used as a binder for the ground stripe. They include polycarbonates, polyesters, polyacrylic acid and its copolymers, polyurethanes, acrylate polymers, methacrylate polymers, cellulose polymers, polyamides, nylon, polybutadiene, poly(vinyl chloride), polyisobutylene, polyethylene, polypropylene, polyterephthalate, polystyrene, styrene-acrylonitrile copolymer, and the like and mixtures thereof. Preferably, the binder is a polyester such as Vitel 2200 (obtained commercially from Shell Chemical Co., Apple Grove, W.Va.)

Optional conventional additives, such as, for example, surfactants, fillers, coupling agents, fibers, lubricants, wetting agents, pigments, dyes, plasticizers, release agents, suspending agents, and curing agents, may be included in the ground stripe of the present invention.

The invention will now be described further by way of the following examples.

EXAMPLES

A. Organophotoreceptor

An inverted dual layer organophotoreceptor was prepared utilizing Compound 2 as described in U.S. Pat. No. 6,066,426. The organophotoreceptor included a polyester layer, an aluminum layer, a sub-layer (formed from Vitel® PE 2200, commercially obtained from Bostik Chemicals, Middleton, Mass., at a 4.4% solids in a 2:1 methyl ethyl ketone:toluene mixture, coated at a thickness of 0.2 micrometers using a slot die coater with a web speed of 3.048 m/min., dried in 4 oven zones of 110° C., 120° C., 140° C., and 150° C.), a charge transport layer, and a charge generating layer.

Two different barrier layer solutions were coated on the organophotoreceptor obtained above. The first ("Barrier A") was prepared by mixing 86.3 g of 3% Methocel® A15L V in water, 86.3 g of 3% Gantrez® AN-169 polymer (obtained commercially from ISP Technologies) in water, 172.44 g of methanol, 0.65 g of 40% Glyoxal 40 in water, and 0.07 g Triton X-100 surfactant. The other barrier layer solution ("Barrier B") was prepared by combining 217.6 g of 6% S-Lec BX-5 polyvinyl butyral resin, 1385.7 g isopropyl alcohol, 33.5 g Nalco 1057 colloidal silica, 33.1% Z-6040 silane (Dow Coming 50/50 in isopropyl alcohol/water), and 130.17 g Gantrez AN-169 polymer. The barrier layer solution was die coated onto the dual layer organophotoreceptor and dried to form a layer having a nominal thickness of 0.4 micrometer.

A tie layer was coated on top of the barrier layer. The tie layer was formed from a tie layer coating composition including 3.1% poly(hydroxy amino ether) (trade designation XUR, commercially obtained from Dow Chemical, Midland, Mich.), 58.1% tetrahydrofuran, and 38.8% 1-methoxy-2-propanol. The tie layer was coated with a 4 mil (0.01016 cm) shim and a 5 micron filter at a web speed of 3.048 m/min. The coating was dried by 4 oven zones set at 90° C., 100° C., 110° C., and 110° C.

A release coating was coated on the top of the tie coat. The release coating solution contained 0.735% VDT-954 (commercially obtained from Gelest, Inc.), 2.626% SE-33 silicone resin (commercially obtained from GE Silicones), 1.176% DMS-V52 gum (commercially obtained from Gelest, Inc.), 0.5% Syloff® 7048 (commercially obtained from Dow Corning), 0.1575% Syloff® 4000 catalyst (commercially obtained from Dow Corning), 0.03675% diethyl fumarate (commercially obtained from Aldrich), 0.01575% benzyl alcohol (commercially obtained from Aldrich), 0.02625 Cab-O-Sil 720 (commercially obtained from Cabot Corp), 15% methyl ethyl ketone and 79.727% heptane. The release coating composition was coated and subsequently cured at 150° C. for 1.5 minutes. The coating thickness of the release coating was 0.65 micrometer.

The inverted dual layer organophotoreceptor web obtained above was cut into 86 cm long and welded into a belt by an ultrasonic welder with a Branson 900B power supply with a Branson welding horn, booster, and converter (commercially obtained from Branson Ultrasonics Corp., Danbury, Conn.).

The belt was tested in a printing test according to the following condition. The liquid inks used in the printing test were obtained according to the procedure as described in U.S. Pat. No. 6,066,426. The belt was mounted and tested on a homemade printing machine similar to the one described in FIG. 3. The organophotoreceptor belt was traveling at 76.2 mm/s (3 in/s). A positively charged cyan ink was used. The voltage of the electrically conductive substrate of the organophotoreceptor belt was held at zero volt. The developer voltage was set at 500 volts before the seam entered the developer nip. When the seam approached and was 3.8 mm away from the developer nip, the developer voltage was quickly lowered to zero volt in 100 milliseconds. The developer voltage was quickly returned to 500 volts in 100 milliseconds just after the seam passes through and was 3.8 mm (e.g., within 1 and 5 mm is a highly useful range) away from the developer nip. The prints on letter size paper obtained by the above process showed no seam marks. The prints obtained by the above process with the developer voltage remained unchanged when the seam passed the developer nip showed obvious seam marks.

A four-color printing test with cyan ink, yellow ink, magenta ink, and black ink was done similar to the procedure described above except four developer stations were used. The prints on letter size paper obtained by the above process showed no seam marks when the developer voltages were changed momentarily. The prints obtained by the above process with the developer voltage remained unchanged when the seam passed the developer nip showed obvious seam marks.

While the present invention has been described with respect to it preferred embodiments, it is to be recognized and understood that changes, modifications and alterations in the form and in the details may be made without departing from the scope of the following claims.

What is claimed is:

1. An electrophotographic imaging process comprising:

providing an organophotoreceptor belt on an imaging apparatus, the photoreceptor belt having a photoconductive element on an electrically conductive substrate and a seam on the photoreceptor belt, the photoreceptor belt moving with respect to a developer roll;

providing an imaging apparatus comprising a the developer roll;

applying a first voltage to the photoconductive element;

applying a second voltage to the developer roll as the developer voltage;

applying a third voltage to the developer roll when the seam is at a distance less than 10% of the circumference of the organophotoreceptor belt from the developer roll;

applying a fourth voltage to the electrically conductive substrate;

moving the organophotoreceptor belt;

after the first voltage, second voltage, third voltage and fourth voltage have been applied to the electrically conductive substrate, imagewise exposing the surface of the organophotoreceptor belt to radiation to reduce voltage in selected areas and thereby form a pattern of high voltage and low voltage areas on the surface;

then contacting the surface with a liquid ink comprising colorant particles in an organic liquid to create a toned image; and transferring the toned image to a receiving medium;

wherein the third voltage is equal or less than the fourth voltage when the first and second voltages are positive.

2. An electrophotographic imaging process according to claim 1 wherein the second voltage is not greater than the first voltage if the first voltage is positive.

3. An electrophotographic imaging process according to claim 1 wherein the second voltage is not greater than the first voltage if the first voltage is positive.

4. An electrophotographic imaging process comprising:

providing an organophotoreceptor belt on an imaging apparatus, the organophotoreceptor belt having a photoconductive element on an electrically conductive substrate and a seam, the organophotoreceptor belt moving with respect to a developer roll;

providing an imaging apparatus comprising the developer roll and a squeegee roller;

mounting the organophotoreceptor belt on the imaging apparatus;

applying a first voltage to the photoconductive element;

applying a second voltage to the developer roll;

applying a third voltage to the developer roll when the seam is at a distance less than 10% of the circumference of the organophotoreceptor belt from the developer roll, subsequently applying a second voltage to the developer roll;

applying a fourth voltage to the electrically conductive substrate;

applying a fifth voltage to the squeegee roller;

moving the organophotoreceptor belt;

after the application of the first voltage, the second voltage, the third voltage, the fourth voltage and the fifth voltage, imagewise exposing the surface of the organophotoreceptor belt to radiation to reduce voltage in selected areas and thereby form a pattern of high voltage and low voltage areas on the surface;

contacting the surface with a liquid ink comprising colorant particles in an organic liquid to create toned image image; and transferring the toned image to a receiving medium;

wherein the third voltage is equal or less than the fourth voltage when the first and third voltages are positive.

5. An electrophotographic imaging process according to claim 3 wherein when the squeegee roller has a resistivity lower than $1\times10^{10}$ ohm/square and moving the seam with respect to the squeegee and developer roll and when the seam has moved to a distance less than 10% of the circumference of the organophotoreceptor belt from the developer roll, the fifth voltage on the squeegee roller is changed to a sixth voltage;

wherein the sixth voltage is equal or less than the fourth voltage when the first and second voltages are positive.

6. An electrophotographic imaging process comprising:

providing an organophotoreceptor belt on an imaging apparatus, the photoreceptor belt having a photoconductive element on an electrically conductive substrate and a seam, wherein the organophotoreceptor belt moves with respect to a developer roll, a developer bias voltage being maintained between the developer roll and the organophotoreceptor belt;

providing an imaging apparatus comprising a the developer roll;

applying a first voltage to the photoconductive element;

moving the organophotoreceptor belt;

exposing the surface of the organophotoreceptor belt to radiation to reduce voltage in selected areas and thereby form a pattern of high voltage and low voltage areas on the surface;

then contacting the surface with a liquid ink comprising colorant particles in an organic liquid to create a toned image; and transferring the toned image;

wherein the developer bias voltage is lowered when the developer roll is near the seam to a value which is not greater than the voltage of the seam if a positively charged ink is being used.

7. A method for reducing the effects of seams in images produced in an electrophotographic imaging process comprising:

providing an organophotoreceptor belt with a seam on an imaging apparatus, the photoreceptor belt having a photoconductive element on an electrically conductive substrate and a seam, the organophotoconductor belt moving with respect to a developer roll;

providing an imaging apparatus comprising a the developer roll;

applying a first voltage to the photoconductive element;

applying a second voltage to the developer roll;

applying a third voltage to the developer roll when the seam is at a distance less than 10% of the circumference of the organophotoreceptor belt from the developer roll;

applying a fourth voltage to the electrically conductive substrate;

moving the organophotoreceptor belt;

after four voltages have been applied to the electrically conductive substrate, imagewise exposing the surface of the organophotoreceptor belt to radiation to reduce voltage in selected areas and thereby form a pattern of high voltage and low voltage areas on the surface;

then contacting the surface with a liquid ink comprising colorant particles in an organic liquid to create a toned image; and transferring the toned image to a receiving medium;

wherein the third voltage is equal or less than the fourth voltage when the first and second voltages are positive.

8. The electrophotographic imaging process according to claim 7 wherein the second voltage is not greater than the first voltage if the first voltage is positive.

9. An electrophotographic imaging process according to claim 7 wherein the second voltage is not greater than the first voltage if the first voltage is positive.

10. An electrophotographic imaging process comprising:

providing an organophotoreceptor belt on an imaging apparatus, the photoreceptor belt having a photoconductive element on an electrically conductive substrate and a seam on the photoreceptor belt, the photoreceptor belt moving with respect to a developer roll;

providing an imaging apparatus comprising the developer roll;

applying a first voltage to the photoconductive element;

applying a second voltage to the developer roll as the developer voltage;

applying a third voltage to the developer roll when the seam is at a distance less than 10% of the circumference of the organophotoreceptor belt from the developer roll;

applying a fourth voltage to the electrically conductive substrate;

moving the organophotoreceptor belt;

after the first voltage, second voltage, third voltage and fourth voltage have been applied to the electrically conductive substrate, imagewise exposing the surface of the organophotoreceptor belt to radiation to reduce voltage in selected areas and thereby form a pattern of high voltage and low voltage areas on the surface;

then contacting the surface with a liquid ink comprising colorant particles in an organic liquid to create a toned image; and transferring the toned image to a receiving medium;

wherein the third voltage is equal to or greater than the fourth voltage when the first and second voltages are negative.

11. An electrophotographic imaging process according to claim 10 wherein the second voltage is not greater than the first voltage if the first voltage is positive.

12. An electrophotographic imaging process according to claim 10 wherein the second voltage is not less than the first voltage if the first voltage is negative.

13. An electrophotographic imaging process according to claim 3 wherein when the squeegee roller has a resistivity lower than $1\times10^{10}$ ohm/square and moving the seam with respect to the squeegee and the developer roll and when the seam has moved to a distance less than 10% of the circumference of the organophotoreceptor belt from the developer roll, the fifth voltage on the squeegee roller is changed to a sixth voltage;

wherein the sixth voltage is equal or greater than the fourth voltage when the first and second voltages are negative.

14. An electrophotographic imaging process comprising:

providing an organophotoreceptor belt on an imaging apparatus, the organophotoreceptor belt having a photoconductive element on an electrically conductive substrate and a seam, the organophotoreceptor belt moving with respect to a developer roll;

providing an imaging apparatus comprising the developer roll and a squeegee roller;

mounting the organophotoreceptor belt on the imaging apparatus;

applying a first voltage to the photoconductive element;

applying a second voltage to the developer roll;

applying a third voltage to the developer roll when the seam is at a distance less than 10% of the circumference of the organophotoreceptor belt from the developer roll, subsequently applying a second voltage to the developer roll;

applying a fourth voltage to the electrically conductive substrate;

applying a fifth voltage to the squeegee roller;

moving the organophotoreceptor belt;

after the application of the first voltage, the second voltage, the third voltage, the fourth voltage and the fifth voltage, imagewise exposing the surface of the organophotoreceptor belt to radiation to reduce voltage in selected areas and thereby form a pattern of high voltage and low voltage areas on the surface;

contacting the surface with a liquid ink comprising colorant particles in an organic liquid to create toned image image; and transferring the toned image to a receiving medium;

wherein the third voltage is equal or greater than the fourth voltage when the first and second voltages are negative.

15. An electrophotographic imaging process comprising:

providing an organophotoreceptor belt on an imaging apparatus, the photoreceptor belt having a photoconductive element on an electrically conductive substrate and a seam;

providing an imaging apparatus comprising a developer roll;

applying a first voltage to the photoconductive element;

applying a second voltage to the developer roll when the seam is at a distance less than 10% of the circumference of the organophotoreceptor belt from the developer roll, otherwise a third voltage;

applying a fourth voltage to the electrically conductive substrate;

moving the organophotoreceptor belt;

after four voltages have been applied to the electrically conductive substrate, imagewise exposing the surface of the organophotoreceptor belt to radiation to reduce voltage in selected areas and thereby form a pattern of high voltage and low voltage areas on the surface;

then contacting the surface with a liquid ink comprising colorant particles in an organic liquid to create a toned image; and transferring the toned image to a receiving medium;

wherein the second voltage is equal or less than the fourth voltage when the first and third voltage are positive and wherein the second voltage is not greater than the first voltage if the first voltage is positive, and the squeegee roller has a resistivity lower than $1\times10^{10}$ ohm/square and, moving the seam with respect to the developer roll, so that when the seam has moved to a distance less than 10% of the circumference of the organophotoreceptor belt from the developer roll, the fifth voltage on the squeegee roller is changed to a sixth voltage;

wherein the sixth voltage is equal or less than the fourth voltage when the first and third voltage are positive.

16. An electrophotographic imaging process comprising:

providing an organophotoreceptor belt on an imaging apparatus, the photoreceptor belt having a photoconductive element on an electrically conductive substrate and a seam;

providing an imaging apparatus comprising a developer roll;

applying a first voltage to the photoconductive element;

applying a second voltage to the developer roll when the seam is at a distance less than 10% of the circumference of the organophotoreceptor belt from the developer roll, otherwise a third voltage;

applying a fourth voltage to the electrically conductive substrate;

moving the organophotoreceptor belt;

after four voltages have been applied to the electrically conductive substrate, imagewise exposing the surface of the organophotoreceptor belt to radiation to reduce voltage in selected areas and thereby form a pattern of high voltage and low voltage areas on the surface;

then contacting the surface with a liquid ink comprising colorant particles in an organic liquid to create a toned image; and transferring the toned image to a receiving medium;

wherein the second voltage is equal or less than the fourth voltage when the first and third voltage are positive and wherein the second voltage is not greater than the first voltage if the first voltage is positive, and the squeegee roller has a resistivity lower than $1\times10^{10}$ ohm/square and, moving the seam with respect to the developer roll, so that when the seam has moved to a distance less than 10% of the circumference of the organophotoreceptor belt from the developer roll, the fifth voltage on the squeegee roller is changed to a sixth voltage;

wherein the sixth voltage is equal or greater than the fourth voltage when the first and third voltage are negative.

* * * * *